United States Patent [19]

Blankschein

[11] Patent Number: 4,944,561

[45] Date of Patent: Jul. 31, 1990

[54] PROCESS AND APPARATUS FOR PRODUCING BUNCHES OF ARTIFICIAL OR NATURAL BRUSH MATERIAL

[76] Inventor: Werner Blankschein, Grandlstrasse 59a, 8000 München 60, Fed. Rep. of Germany

[21] Appl. No.: 304,880

[22] Filed: Jan. 30, 1989

Related U.S. Application Data

[63] Continuation of Ser. No. 47,631, May 7, 1987, abandoned.

[30] Foreign Application Priority Data

May 21, 1986 [DE] Fed. Rep. of Germany ..... 3616976

[51] Int. Cl.[5] ..... A46D 1/10

[52] U.S. Cl. ..... 300/10; 300/19

[58] Field of Search ..... 300/5, 7, 8, 10, 19

[56] References Cited

U.S. PATENT DOCUMENTS 3,836,199 9/1974 Blankschein ..... 300/21.19

FOREIGN PATENT DOCUMENTS 2214727 9/1973 Fed. Rep. of Germany ..... 300/8

2415266 10/1975 Fed. Rep. of Germany ..... 300/8

*Primary Examiner*—Joseph M. Gorski

*Attorney, Agent, or Firm*—Hoffmann & Baron

[57] ABSTRACT

A process for producing brush heads is disclosed which includes providing a bundle of brush material, which is separated into a plurality of bunches of brush material to provide respective brush heads. The plurality of bunches of brush material are inserted into apertures in an apertured plate, with support needles engaged in the respective bundles in the apertured plate. The number, length, shape and thickness of the needles are dependent on the nature, amount, length and shape of the brush material. The apertured plate with the bunches of brush material in the apertures thereof is then fitted to a shaping unit, with the brush material being slid into shaping sockets in the shaping unit, the tips of the bunches providing the respective brush heads assuming the configuration imparted thereto by the blind ends of the shaping sockets. After withdrawal of the apertured plate, a further apertured plate having apertures therein of the desired diameter for the brush heads is pushed over exposed ends of the bunches of the brush heads. Then the ends of the bunches of brush material are fixed by means of an adhesive, after which the second apertured plate is removed from the apparatus.

18 Claims, 2 Drawing Sheets

PROCESS AND APPARATUS FOR PRODUCING BUNCHES OF ARTIFICIAL OR NATURAL BRUSH MATERIAL

This is a continuation of co-pending application Ser. No. 0/047,631 filed on May 7, 1987 and now abandoned.

BACKGROUND OF THE INVENTION

The present invention generally concerns a process for the production of bunches of artificial or natural hair, fibre or bristle material which is held together in the form of a bundle, for forming the heads of brushes of various sizes, and an apparatus for carrying out such a process.

In this specification, the hair, fibre or bristle or like material will be referred to generally as brush material to embrace such various kinds of material, while the bunches which are made up of such material or materials will be referred to for the sake of simplicity as a brush head.

My U.S. Pat. No. 3,836,199 discloses a process and an apparatus for producing brush heads from hairs or bristles as brush material, wherein a bundle or hairs or bristles is introduced into a perforated plate having a plurality of apertures therein, the plate referred to as an apertured plate, by means of the root ends of the hairs or bristles, with oscillations or vibrations being applied thereto, and then a pin-bearing plate which corresponds to the apertured plate and the pins on which correspond to the desired contour of the brush heads is inserted from below at the root end into the apertured plate. Oscillations or vibrations are also applied to the assembly when the pin plate is being introduced into the apertured plate. The bunches of hairs or bristles, or brush heads, which are formed in that way, are then provided at their root ends with a liquid binding agent and, after the layer of applied binding agent has set, the individual bunches or heads are successively ejected in groups from the apertured plate by means of a suitable ejector plate.

That process and apparatus however do not operate satisfactorily when producing bunches or brush heads from artificial brush material and also when producing bunches or brush heads from natural brush material when the amount of brush material in each bunch or brush head is less than a given amount. Natural hairs have regularly arranged, small, resilient projections or tangs on their outsides, and, when hairs are in closely juxtaposed relationship with each other, those projections or tangs cause the hairs to be resiliently mutually repelled while they also become hookingly engaged with each other to a certain degree. Such interlocking between the adjacent hairs causes a bunch of such hairs to have a certain amount of inherent stability and cohesion. That effect is utilised in the process briefly outlined above, in such a way that the individual hairs of a bundle thereof which is introduced into a holder, in spite of the difference in area of the aperture in the holder into which the hairs are fitted and the sum of the areas of the apertures in the apertured plate, due to the surface areas of the wall portions between the apertures in the apertured plate, stand upright in the holder although there are small spaces between the individual hairs in the bunch thereof. Furthermore, by virtue of the above-indicated effect of the projecting tangs on the outsides of natural hairs, the amount of hair in each bunch of hairs could be varied within certain limits, in spite of using the same apparatus, that is to say, with the same number and diameter of apertures for receiving the respective bunches of hairs. When the amount of hairs in a given bunch falls below a given limit value, the hairs have a tendency to lean towards the side, so that it is then no longer possible to provide for uniform distribution of the hairs in the apertures in the apertured plate, and it is likewise no longer possible to cause the hairs to lie correctly in the apertures in the apertured plate, under the effect of the applied oscillations or vibrations.

In contrast, the outsides of synthetic or artificial brush material or artificial hairs are smooth and do not have resilient projecting tangs as referred to above, so that the above-indicated effect of mutual repulsion of adjacent hairs no longer occurs. That means that, after a bunch of artificial brush material has been introduced into a holder therefor, the individual hairs, fibres, bristles or like brush material tend to lean in different directions in a disordered manner as the small spaces between the individual hairs, fibres, bristles or the like can no longer be filled up, as was the case with natural hair when the spaces in question were filled by the presence of the projecting tangs. The absence of the resilient repulsion effect is a particularly disadvantageous consideration when dealing with artificial hairs or the like which are of a conical or tapering shape. In that situation, the spaces between the hairs, bristles, fibres or the like brush material, which are already to be found at the root end thereof, increase continuously in size to the tips of the hairs or like brush material, so that random tilting of the artificial hairs or like brush material is still further increased.

By virtue of the fact that the contour of the bunches or brush heads is essentially produced by inserting a pin plate which is provided with correspondingly shaped pins adapted to engage into the respective bunches of brush material, substantial fluctuations in shape occur when using hairs of different lengths, which frequently happens when dealing with natural hairs.

SUMMARY OF THE INVENTION

An object of the present invention is to provide a process for producing brush heads of synthetic or natural brush material such that the amount of hair in each bunch forming a brush head can te varied and controlled within wide limits.

Another object of the present invention is to provide a process for producing brush heads of natural or synthetic brush material, wherein the individual bunches forming respective brush heads can be of substantially uniform shape and configuration.

Still another object of the present invention is to provide a process for producing brush heads comprising bunches of natural or artificial brush material, which do not suffer from substantial fluctuations in shape and intended size from one brush head to another.

A further object of the present invention is to provide an apparatus for producing brush heads from natural or artificial brush material, which operates in a simple and reliable manner.

In accordance with the present invention those and other objects are achieved by a process for producing brush heads consisting of natural or synthetic brush material such as hairs, fibres, bristles or the like, which are held together to provide a bundle. The brush material is brought together to provide such a bundle, and a perforated apertured plate is introduced into the root region of the bundle, under the effect of oscillations or vibrations applied thereto, to define individual bunches or brush heads in the respective apertures in the apertured plate, and then the tips of the bunches or brush heads of the brush material disposed in the apertures are formed or shaped, whereafter the root ends of the bunches or brush heads are fixed with a liquid binding agent and removed from the apertured plate. Support needles which are directed approximately in the direction of the brush material are introduced into the bundle of brush material, in the direction towards the root end thereof, the number of such needles being selected proportionally to the number of apertures in the apertured plate, while the number, length, shape and thickness of the needles is dependent on the nature, amount, length and shape of the brush material involved.

In a preferred feature of the invention, the shape or form of the needles is adapted to the respective shape or form of the brush material. In that way, the amount of hairs or like brush material in each bunch thereof can be controlled and varied in a particularly fine manner.

In accordance with a further aspect of the present invention, the above-indicated objects can be achieved by an apparatus for producing brush heads of a brush material such as hairs, fibres, bristles or the like, which are brought together to form a bundle, comprising a brush material holder having a bottom region and a side region and which is adapted to hold the bundle of hairs, bristles or the like, together with a perforated or apertured plate which can be fitted on to the holder, and a shaping or forming means for shaping the contour of the tips of the brush heads. The apparatus further comprises a plurality of support needles which extend from the bottom region of the holder at least substantially perpendicularly thereto, the number of said needles being proportional to the number of apertures in the apertured plate and their number, length, shape and thickness being dependent on the nature, amount, length and form of the brush material.

A particular advantage of the process and apparatus according to the principles of the present invention is that the support needles which penetrate into the bundle of artificial brush material fill or eliminate the small spaces which occur between the individual artificial hairs, fibres, bristles or the like constituting the brush material, and support the bundle of brush material or the individual hairs or the like thereof, whereby the brush material is held perpendicularly in the brush material holder, thus permitting the introduction and uniform distribution of the brush material, under the effect of oscillations or vibrations. The desired option of varying and controlling the amount of hairs, fibres, bristles or the like brush material within wide limits is achieved in particular by virtue of the selection of support needles in regard to number, shape, thickness and length. In that connection, when producing bunches or brush heads from artificial brush material, the sum of the frontal areas of the support needles should correspond at least to the sum of the areas between the apertures in the apertured plate in order to ensure that the spaces which are formed by virtue of the presence of the above-mentioned areas of the apertured plate between the apertures thereof are satisfactorily filled. The diameters of the support needles are preferably to be increased when using brush material consisting of hairs, fibres, bristles or the like which are of a tapering or other configuration, although attention is to be given to the depth of penetration and the form of the support needles. The amount of brush material used can also be reduced, in which case the number or the thickness of the supPort needles is to be correspondingly increased as compensation. Generally speaking, care is to be taken in that respect to ensure that the sum of the frontal areas of all needles and the sum of the frontal areas of the brush material are to be equal to the area of the opening in the brush material holder, as measured in the region of the ends of the needles which are towards the bundle of brush material. When using support needles which are of a shaped configuration, for example support needles which are conical or tapering or of a lobar shape, the above-mentioned conditions should be fulfilled at least at one location, advantageously in the tip region of the support needles, in the opening of the brush material holder, in order to ensure proper support for the brush material.

The process and apparatus in accordance with the present invention can also be used with advantage when employing natural brush material as the amount of brush material per bunch or brush head can be varied within substantially wider limits than in the case of the known process, and can be more finely controlled. That is again achieved by variations in the support needles in the brush material, in regard to their number, shape, length and thickness, in which respect, due to the irregular effect of the resilient projecting tangs on the natural hairs, in different brush materials, the number and dimensions of the support needles are to be ascertained empirically.

In further developments of the apparatus in accordance with the principles of the present invention, the brush material holder may be of an integral construction in particular for mass production purposes, or it may comprise a plurality of mutually interchangeable components such as a base plate, a needle-bearing plate, a charging means, and spacer elements, for example when producing small numbers of bunches or brush heads.

Another advantage of the process according to the invention is that fluctuations in the contours of the bunches or brush heads which are to be made from any suitable brush material can be at least substantially avoided, in spite of using different lengths for the brush material. That can be achieved by a shaping operation for shaping the bunches or brush heads being carried out simultaneously in respect of a plurality thereof, directly at the tips of the brush material. The shaping operation can thus be carried out in a more precise and rapid manner.

The process in accordance with the principles of this invention can also be used for the production of bunches of brush material of any desired shape or configuration, for example bunches of a flat or oval shape. In that case the apertures in the apertured plate and the opening in the brush material holder which accommodates the bundle of brush material to be formed into the respective bunches must be of a suitable shape or, in an alternative form of the process, sockets or recesses which accommodate the brush material to form same into respective bunches or brush heads must be of a suitable configuration, while similarly the length, shape, thickness and number of the support needles must be appropriately adapted and designed.

In still another aspect of the present invention, in operation of the apparatus in accordance with the invention, the invention provides for electrical grounding over as large a surface area as possible in respect of the apparatus of the invention as well as the vibration or oscillation generating device, working surfaces and personnel, thereby reducing static charges at the brush material and therewith mutual attraction of the brush material during the production process, which would interfere with the distribution, subdivision and shaping operations to be carried out on the brush material to provide the respective bunches or brush head units.

Further objects, features and advantages of the present invention will be apparent from the following description of a preferred embodiment.

DESCRIPTION OF THE PREFERRED EMBODIMENT

The apparatus comprises generally the units shown in FIGS. 1 and 2, and FIGS. 3 and 4 respectively.

Figure 1:
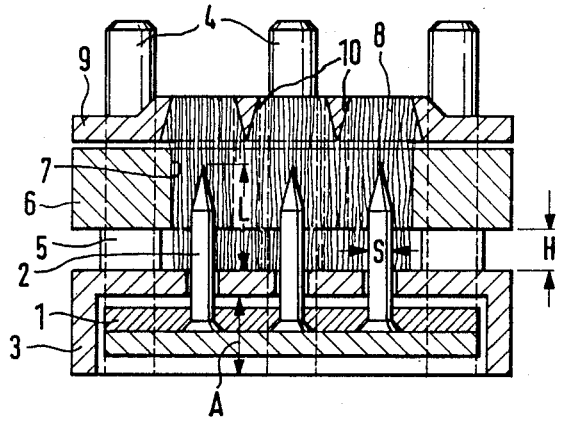
FIG. 1 is a view in vertical longitudinal section of an embodiment of the apparatus in accordance with the invention for introducing a bundle consisting of any suitable brush material and for dividing same into individual bunches.

Referring firstly to FIG. 1, shown therein is a first part of the apparatus comprising a base plate 1 on which support needles 2 of suitable thickness are fixed in perpendicular relationship therewith. The term needle is used in this specification to indicate any member of the general configuration illustrated and adapted to perform the function required in respect thereof, as described hereinafter.

The needles 2 pass through openings which are suitably arranged in a needle plate member 3, with the needles 2 being axially movable in the openings in the plate member 3. While the needles 2 engage into the openings in the plate member 3, the base plate 1 engages into a recess which is provided for receiving same and which is adapted in respect of configuration thereto, at the underside of the plate member 3. The plate member 3 is thus of an inverted cup-like configuration in the sectional view in FIG. 1.

Figure 2:
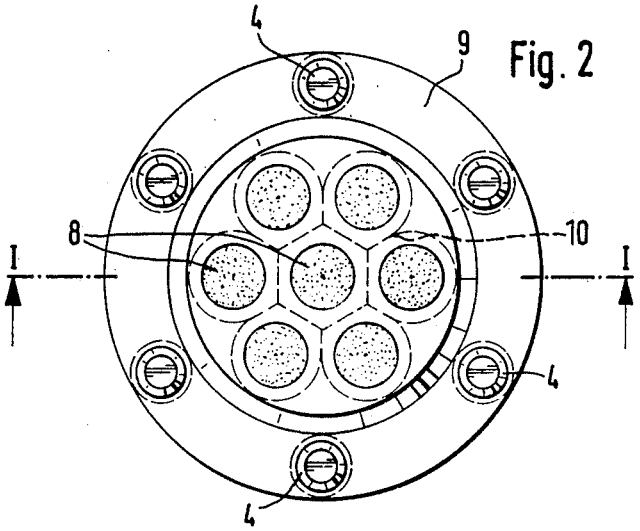
FIG. 2 is a plan view of the apparatus shown in FIG. 1.

The base plate 1 is movable in the axial direction as indicated by A within limits which are determined by the depth of the recess in the underside of the plate member 3, whereby the length of the needles 2 which projects beyond the plate member 3, as indicated by L in FIG. 1, may be correspondingly varied. Guide elements in the form of guide pins 4 are arranged on the top side of the plate member 3, in the edge regions thereof. The positions of the guide pins 4 can be clearly seen from FIG. 2. A spacer tube portion 5 of a height H can be pushed on to each of the guide pins 4, until it comes into contact with the plate member 3. A charging ring 6 can also be fitted on to the guide pins 4, by way of suitably arranged holes therein. The ring 6 has a central opening which extends therethrough in the axial direction thereof, with the inside peripheral surface 7 of the opening in the ring 6 being of a shape corresponding to the shape of the outside surfaces of the bunches or brush heads to be produced from the brush material such as hair, fibre or bristle material. The needles engage into the opening in the ring 6 during the movement of fitting the ring 6 on to the guide pins 4, being adapted to the nature and the amount of the brush material as indicated at 8 in FIG. 1. Thus, to use the illustrated apparatus, a bundle of brush material 8 is introduced into the opening in the ring 6, with the ends of the brush material 8 which are to be provided with a layer of adhesive being directed upwardly. Under the effect of oscillations or vibration induced by any suitable vibration generating means (not illustrated) which can be brought into operative association with the illustrated apparatus, the brush material is uniformly distributed within the opening defined by the ring 6. Then, with oscillations or vibrations being applied at the same time, a perforated apertured plate 9 having a plurality of apertures therethrough, as clearly shown in FIG. 2, is fitted onto and lowered on the guide pins 4 on which the ring 6 is also carried. The plate 9 has suitably arranged bores for fitting on to the guide pins 4. In that operation, the brush material 8 which projects beyond the ring 6 is introduced into the apertures in the apertured plate 9 and thereby subdivided into a number of bunches or brush heads, which number is predetermined by the number of apertures in the apertured plate 9. The length L and the thickness S of the respective needles 2 as well as the height H of the spacer tube portions 5 must be matched or adapted to the length, shape and amount of the brush material 8, in which respect care is to be taken to ensure that the support needles 2 represent the necessary support effect in order to hold the brush material 8 in perpendicular relationship in the ring 6. In principle, when using artificial brush material, the sum of the frontal surface areas of the needles 2 must correspond at least to the sum of the areas as indicated at 10 between the apertures in the apertured plate 9, as measured in the region of the upper ends of the needles, in order to ensure that the spaces between individual, for example cylindrical hairs, fibres, bristles or the like of the brush material 8 are adequately filled. As indicated in FIG. 10, the region defined within the bounds delimited by dotted lines indicated by numeral 10, is generally defined as the surface area between contiguous apertures of the apertured plate and the surface area circumscribing those portions of the apertures which are not completely surrounded by adjacent apertures (i.e. the outer ring of apertures). The circumscribing surface area of each non completely surrounded aperture is generally equal to about one half of the surface area circumscribing each aperture which contributes to the surface area between contiguous apertures. When the brush material 8 comprises hairs, fibres, bristles or the like which are of a tapering or any other configuration or when the amount of brush material in the ring 6 is reduced, the thickness S and the length L of the needles 2 or the shape of the needles 2 must be suitably altered or adapted, for example using tapering needles 2.

FIG. 2 shows a plan view of the apertured plate 9 which is fitted on to the guide pins 4. It will be seen that the brush material 8 which is disposed in the respective apertures in the apertured plate 9 is divided into respective bunches or brush heads with the surfaces or areas as indicated at 10 disposed therebetween.

Figure 3:
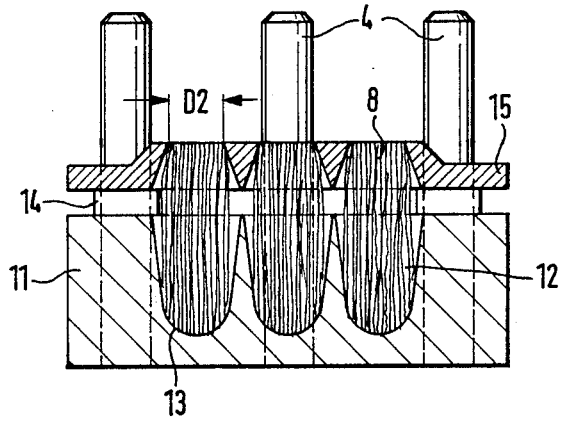
FIG. 3 is a view in vertical longitudinal section of an embodiment of a part of the apparatus for shaping or contouring the individual bunches of brush material.

Reference will now be made to FIG. 3 showing a cylindrical shaping means indicated at 11, which is provided with guide pins 4. The shaping means 11 has shaping recesses or sockets 12 which open to the upwardly facing surface of the shaping means 11, as can be clearly seen from FIG. 3. The sockets or recesses 12 are arranged in a manner corresponding to the arrangement of the apertures in the apertured plate 9. The lower ends of the sockets or recesses 12, which are indicated at 13 in FIG. 3, are of a shape and configuration corresponding to the desired contour at the tips of the bunches or brush heads formed by the brush material 8, the ends of the brush heads or bunches of brush material thus being of a hemispherical configuration in the illustrated embodiment. The walls of the sockets or recesses 12 extend in a conical or tapering configuration to the upwardly facing surface of the shaping means 11. Narrow web portions are formed in the upwardly facing surface of the shaping means 11, between the sockets or recesses 12, as can be clearly seen from FIG. 3.

It will be appreciated that the guide pins 4 are arranged in the same manner and are of the same thickness as the guide pins 4 on the needle plate member 3 described above with reference to FIGS. 1 and 2.

Figure 4:
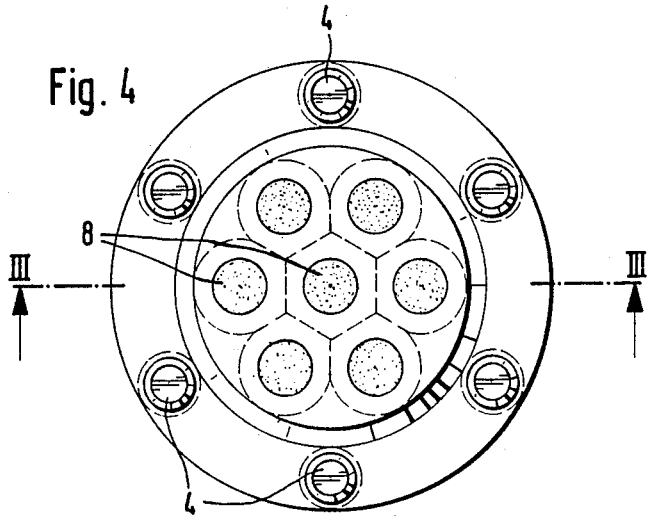
FIG. 4 is a plan view of the arrangement shown in FIG. 3.

In operation of the apparatus, firstly the apertured plate 9 which has been removed from the arrangement shown in FIG. 1, including the brush material in the apertures in the apertured plate 9, is pushed on to the guide pins 4 shown in FIGS. 3 and 4. The spacing between the shaping means 11 and the apertured plate 9 is determined by means of spacer tube portions 14 which are fitted on to the guide pins 4, as indicated in FIG. 3. Under the effect of oscillations or vibrations produced by any suitable form of oscillation generator (not shown) which can be brought into operative association with the apparatus of the invention, the brush material 8 is shaken into the recesses or sockets 12 in the shaping means 11, the brush material 8 thus leaving the apertured plate 9 and the tips of the brush material 8 which is thus divided into respective bunches or brush heads being put into the desired or predetermined contour or shape, by virtue of engaging into the recesses or sockets 12. After the apertured plate 9 and the spacer tube portions 14 have been subsequently removed, the brush material or more specifically the respective bunches thereof project beyond the shaping means 11 in an upward direction in FIG. 3, at least by the thickness of the apertured plate 9. Therefore the sockets or recesses 12 must be of adequate depth to ensure a guiding action in respect of the brush material which is subdivided into the individual bunches.

Then, another apertured plate which is indicated at 15 in FIG. 3 but which is of a similar configuration to the apertured plate 9 and which is provided with apertures corresponding to the positions of the sockets or recesses 12 of the shaping means 11 is fitted on to the guide pins 4. When that is done, the upwardly projecting brush material 8 slides into the apertures in the apertured plate 15, which are suitably arranged for that purpose. The apertures in the apertured plate 15 are of the desired diameter D2 of the brush heads to be produced, at the upper ends of the apertures in the apertured plate 15. The wall surfaces defining the apertures in the apertured plate extend in a conically tapering configuration to the surface of the apertured plate 15 which faces towards the shaping means 11, being therefore the downwardly facing surface of the apertured plate 15 in FIG. 3. At that surface, the apertures thus form narrow web portions between themselves, the width of the web portions being matched to the corresponding web portions formed between the respective sockets or recesses 12 of the shaping means 11.

After the apertured plate 15 has been fitted into position on the shaping means 11, a coating of liquid adhesive is applied to the root ends of the brush material subdivided into the bunches or brush heads in the respective apertures. Due to the capillary action, the liquid adhesive is now sucked between the root ends of the brush material. After the adhesive has adequately set, the apertured plate 15 is removed from the shaping means 11 and the bunches of brush material are then removed from the apertured plate 15.

It will be appreciated that the above-described process and apparatus in accordance with the present invention have been set forth solely by way of example thereof and that various modifications and alterations may be made therein without departing from the spirit and scope of the invention.

I claim:

1. Apparatus for producing brush heads from a brush material consisting of brush material elements having tips and root ends, which brush material is brought together to form a bundle, each said brush head having a root end, said apparatus comprising:

a brush material holder having a bottom portion and a side wall portion, said bottom and side wall portions defining a bundle receiving aperture in said holder, said aperture extending completely through said side wall portion and having an axis extending substantially perpendicularly with respect to said bottom portion, said bottom portion supporting the tips of the brush material elements in said bundle and said side wall portion being of sufficient height above said bottom portion so that the brush material elements are held in the bundle and prevented from falling apart;

an apertured plate capable of being moved towards said holder along said axis, said apertured plate having a plurality of apertures which receive the root ends of respective portions of said bundle of brush material thereby dividing the brush material into a plurality of bunches to form respective brush heads and thereby forming and holding the root ends of said brush heads; and a plurality of support needles having tips projecting into said bundle receiving aperture from the bottom portion substantially in parallel with said axis of said bundle receiving aperture, such that said tips of said support needles remain within said aperture so that after insertion of said bundle of brush material into said bundle receiving aperture, said support needles project lengthwise into the tips of the bundle of brush material in the direction towards the root ends thereof, and laterally displace the brush material elements and press the brush material elements against one another to eliminate spaces therebetween, thereby permitting improved introduction and uniform distribution of the brush material elements through each aperture of said apertured plate when said apertured plate is positioned against said root ends of the brush material of the bundle.

2. Apparatus as set forth in claim 1 wherein said bottom portion of said holder is formed by a first plate member from which said support needles project and which is provided with guide means, the number of said support needles corresponding to the number of brush heads to be produced, and wherein said first plate member can be brought into operative association with an oscillation generating means.

3. Apparatus as set forth in claim 2 wherein said support needles are secured in apertures provided therefor in said first plate member.

4. Apparatus as set forth in claim 2 wherein said support needles are substantially perpendicularly fixed on a base plate member which is movable towards said apertured plate, and said support needles extend through suitably arranged apertures in said first plate member, the length of said support needles which project beyond said first plate member being steplessly adjustable within predetermined limits by producing relative movement between said first plate member and said base plate member.

5. Apparatus as set forth in claim 2 wherein said side wall portion is a structure formed separate from said bottom portion and is adapted to be fitted on to said guide means, said side wall portion having an axial opening therethrough and an axis therealong, to accommodate said bundle of brush material.

6. Apparatus as set forth in claim 5 and further including spacer means adapted to fit between said side wall portion and said first plate member, to provide a spacing therebetween.

7. Apparatus as set forth in claim 5 wherein the size and the edge contour of said opening through said side wall portion and the region of said first plate member at which said needles project is aligned with the apertured region and the edge contour of said apertured plate which is adapted to be fitted on to said side wall portion.

8. Apparatus as set forth in claim 6 wherein the spacing of said side wall portion from said first plate member corresponds to the length and thickness of said support needles, said length and said thickness being adapted to the length and the amount of said brush material, and wherein the height of said side wall portion corresponds to the length of said brush material.

9. Apparatus as set forth in claim 5 wherein, when producing brush heads of artificial brush material, said support needle has a cross-sectional area, and the apertured plate has a frontal surface area, said frontal surface area being generally defined as the surface area surrounding contiguous apertures and exposed to the opening through the side wall portion , the total amount of the cross-sectional area of all said support needles and the total amount of the cross-sectional area of said brush material, as defined in the region of the tips of said support needles, corresponds to the area of said opening through said side wall portion, and wherein the total amount of the cross-sectional area of said support needles is at least equal to said frontal surface area of said apertured plate.

10. Apparatus as set forth in claim 9 wherein said total amount of the cross-sectional area of said support needles is greater than said frontal area of said apertured plate.

11. Apparatus as set forth in claim 2 wherein said apertured plate is adapted to be fitted on to said guide means of said first plate member, the size of the apertures in said apertured plate corresponds to the nature and amount of the brush material to be used and the number of apertures depending on the size of the individual brush heads, and wherein the apertured plate is adapted to be moved in the direction which is predetermined by said guide means into the root ends of the brush material while being subjected to the effect of oscillations.

12. Apparatus as set forth in claim 2 wherein all components of the apparatus, are electrically connected.

13. Apparatus as set forth in claim 2 which further comprises a shaping means for shaping the contour of the tips of the bunches of brush material.

14. Apparatus as set forth in claim 13 wherein said shaping means has a plurality of shaping sockets corresponding in number and distribution to said apertures in said apertured plate and wherein when said apertured plate and said shaping means are brought together, said bunches of brush material under the effect of oscillations, pass out of said apertures, with their end regions remote from the root ends thereof leading, into the respective shaping sockets.

15. Apparatus as set forth in claim 14 including guide means on said shaping means for guiding said apertured plate in relation thereto wherein said shaping means in the region which is in opposite relationship to the apertured region of said apertured plate has a corresponding number of said shaping sockets for accommodating the brush material disposed in said apertures, and wherein the closed ends of said shaping sockets are shaped corresponding to the contour required in respect of the brush heads.

16. Apparatus as set forth in claim 14 wherein the walls of said shaping sockets of said shaping means extend in a tapering configuration from the closed ends of said shaping sockets and terminate in an upwardly facing surface of said shaping means and form narrow web portions between adjacent shaping sockets.

17. Apparatus as set forth in claim 14 wherein the depth of said sockets is dependent on the nature and length of said brush material.

18. Apparatus as set forth in claim 14 and further including a second apertured plate adapted to co-operate with said shaping means under the effect of oscillations, said second apertured plate having a plurality of apertures adapted to accommodate the root ends of the brush material in said shaping sockets, wherein the size of the apertures of said second apertured plate corresponds to the brush head size to be produced and the number of apertures corresponds to the number of shaping sockets of said shaping means, said root ends which are in the upper region of said apertures being positioned to receive a layer of liquid adhesive.

* * * * *